United States Patent [19]

Anderson et al.

[11] 3,965,911

[45] June 29, 1976

[54] SMOKING MIXTURE

[75] Inventors: Robert Craig Anderson; Robert Arthur Hall, both of West Kilbride, Scotland

[73] Assignee: Imperial Chemical Industries Limited, London, England

[22] Filed: May 17, 1974

[21] Appl. No.: 471,148

Related U.S. Application Data

[63] Continuation of Ser. No. 125,812, March 18, 1971, abandoned.

[30] Foreign Application Priority Data

Mar. 23, 1970 United Kingdom ..... 13862/70

[52] U.S. Cl. ..... 131/2; 131/17 R; 131/144

[51] Int. Cl.[2] ..... A24B 15/00; A24D 1/18

[58] Field of Search ..... 131/2, 15, 7, 140–144

[56] References Cited

UNITED STATES PATENTS

| | | | |
|---|---|---|---|
| 2,171,986 | 9/1939 | Poetschke | 131/15 R |
| 3,145,717 | 8/1964 | Osborne et al. | 131/140 C |
| 3,240,214 | 3/1966 | Bavley et al. | 131/140 C |
| 3,312,226 | 4/1967 | Bavley et al. | 131/17 R |
| 3,477,865 | 11/1969 | Armbrust et al. | 131/17 R |
| 3,545,448 | 12/1970 | Mormon et al. | 131/2 |
| 3,684,809 | 8/1972 | Mookherjee | 131/17 UX |

FOREIGN PATENTS OR APPLICATIONS

| | | | |
|---|---|---|---|
| 908,439 | 10/1962 | United Kingdom | 131/17 |

*Primary Examiner*—Robert W. Michell
*Assistant Examiner*—V. Millin
*Attorney, Agent, or Firm*—Cushman, Darby & Cushman

[57] ABSTRACT

Tobacco substitute based smoking mixture including protein as an ingredient to give the smoke from the mixture of flavor resembling that of tobacco.

6 Claims, No Drawings

SMOKING MIXTURE

This is a continuation of application Ser. No. 125,812 filed Mar. 18, 1971 now abandoned.

This invention relates to a smoking mixture suitable for incorporation in cigars, cigarettes and smoke pipes, in total or partial replacement of the tobacco constitutent of the mixtures normally used.

Smoking mixtures normally consist mainly of, or contain, a high proportion of natural tobacco and the opinion is now widely held that the smoking to tobacco, especially in cigarette form, increases the incidence of lung cancer and bronchitic ailments. The replacement of tobacco in smoking mixtures by cellulose and other smoke-producing materials has been proposed but such proposed mixtures have not been accceptable to smokers because the smoke flavour was excessively different from that of tobacco smoke.

It is an object of this invention to provide a smoking mixture based on an organic combustible material which will give a smoke resembling tobacco smoke in flavour.

It is a further object of this invention to provide such a "substitute" based smoking mixture which has a higher "filling" power when used in the manufacture of cigarettes of standard dimensions and standard firmness or feel. By higher filling power is meant the capacity to make cigarettes of standard firmness or feel with less weight of material.

In accordance with the present invention there is provided a smoking mixture comprising an organic combustible material as smoke-producing fuel and protein, the amount of protein to smoke-producing fuel being in the range 1:1 to 1:60.

Preferably the amount of protein to smoke-producing fuel is in the range 1:8 to 1:30.

The organic combustible material may be a smoke-producing carbohydrate.

The smoke-producing carbohydrate may advantageously comprise $\alpha$-cellulose, cellulose derivative, sugars, starch, alignate, pectin or natural gum.

The smoke-producing carbohydrate may be a modified carbohydrate. The modified carbohydrate may advantageously be prepared as disclosed in our U.K. Patent No. 1,113,979 by subjecting carbohydrate to a catalysed degradation process at a temprature of 100°–250°C until the weight of the degraded material is less than 90% of the dry weight of the original carbohydrate.

Preferred degradation catalysts include sulphuric acid, sulphamic acid and ammonium sulphamate.

The modified carbohydrate is preferably thermally degraded cellulose. The modified carbohydrate may also be oxidised cellulose.

The smoke-producing fuel may be an aldol condensation product prepared as described in our co-pending U.K. application No. 22270/69 by acid or base catalysed condensation of a compound of the formula $R^1COCH_2.CH_2COR^2$ (I) (or a precursor thereof), wherein $R^1$ and $R^2$, which may be the same or different, each represents a hydrogen atom, or an alkyl, hydroxyalkyl or formyl group.

The aldol condensation product is preferably a condensate of succinaldehyde or acetonyl acetone or is produced from a precursor of I which is a compound containing a furan ring structure.

The protein should preferably be pure and it is desirable, but not essential, that any residual fat should be removed from the protein, for example, by extraction with an organic solvent. Especially valuable proteins include animal protein, for example, albumin, casein, gelatine, peptone, haemoglobin or wool protein and vegetable proteins, for example, protein from maize (zein), wheat (glutin and gliadin), soyabean or groundnut. Protein acid hydrolysates and protein enzyme hydrolysates, particularly casein acid hydrolysate and casein enzyme hydrolysate, are also suitable.

The smoking mixtures of the invention will, in addition to protein and the smoke-producing fuel, contain other ingredients such as are normally used in smoking mixtures to impart desired physical properties and burning characteristics. For example, the mixtures may include glow-controlling catalysts, materials to improve ash coherence and colour, nicotine, flavourants, medicaments or humectants or film-forming binding agents. The mixtures may also contain tobacco as part of the smoke-producing material. Such added tobacco could be in the form of comminuted tobacco or tobacco shred.

Alkali metal compounds may advantageously be used as glow-controlling catalysts and salts of ammonia, alkali metals or alkaline earth metals may be used as ash improvers.

Alkali or alkaline earth carbonates or porous fillers may be incorporated in the smoking mixtures to give an open texture and facilitate combustion.

More particularly, additional compounds may comprise:

1. Fillers - e.g. calcium carbonate, magnesium carbonate.
2. Humectants - e.g. glycerol, ethylene glycol, polyethylene glycol.
3. Film-forming agents - e.g. methyl cellulose, sodium carboxymethyl cellulose, pectins, gums.
4. Glow-controlling catalysts - e.g. potassium citrate, calcium carbonate, magnesium carbonate.
5. Ash cohesion agents - e.g. citric acid, sodium hydrogen phosphate, tobacco extracts.
6. Solanesol, other similar unconjugated polyisoprenoids and derivatives thereof (e.g. esters, acids and hydroxyl derivatives), may be added to obtain a sweetish aroma from the burning mixture and to give a pleasant after-note in the mouth of the smoker. The smoker mixture containing modified carbohydrate and aldol condensation product may addiitionally contain as a minor component one or more carbohydrate materials such as cellulose fibre, starch or sugar, to improve flavour and physical properties.

The smoking mixture is preferably prepared in a form simulating tobacco. Thus it is preferred to form the mixed ingredients into a sheet and cut or shred the sheet into the physical form required. If the smoke-producing carbohydrate, modified carbohydrate or aldol condensation product used is already sheeted, the smoking mixture may be prepared by merely treating the sheet with the remaining ingredients. In the usual case, where the smoke-producing fuel is in divided form, the ingredients may be admixed and subsequently sheeted. To facilitate sheeting, it is advantageous to incorporate a solution of a binding agent, for example, water-soluble cellulose ether, polyvinyl alcohol or a water-soluble gum, in the mixture.

As aforesaid, an object of the invention is to provide a smoking mixture which has a better filling power.

Filling power is a very important factor in the economics of cigarette manufacture. The fact that the incorporation of protein produces this desirable effect was an unforeseeable and surprising discovery.

The invention is further illustrated by the following Examples in which all parts and percentages are by weight. In each of the Examples the flavour and after-taste of the product was assessed by a panel of smokers. Furthermore, in each of the Examples those ingredients which are not soluble are to be considered as being finely divided.

EXAMPLE 1

2.8 parts glycerol, 0.8 citric acid and 1.0 part potassium citrate were dissolved in 20 parts distilled water and the resultant solution added to a stirred solution of 2 parts sodium carboxymethyl cellulose in 80 parts hot distilled water. 1.27 parts of groundnut protein (lypro), which had been extracted for 48 hours at 30°C with petroleum ether (b.p. 40°/60°C), 2 parts calcium carbonate and 10.13 parts of a material made by heating alpha-cellulose impregnated with 0.51 part of ammonium sulphamate for 4 hours at 200°C, were added to the above solution and the slurry stirred until homogeneous (approximately 1 hour).

The slurry was cast on glass plates to form a film 0.006 in. thick which was cut, shredded and made into cigarettes. These cigarettes, when smoked, had a tobacco-like flavour and after-taste.

EXAMPLE 2

2.8 parts glycerol, 0.8 part citric acid and 1.0 part potassium citrate were dissolved in 20 parts distilled water and the resultant solution added to a stirred solution of 2 parts sodium carboxymethyl cellulose in 80 parts hot distilled water. 1.58 parts of soyabean meal, which had been extracted for 48 hours at 30°C with petroleum ether (b.p. 40°/60°C), 2 parts calcium carbonate and 9.82 parts of alpha-cellulose, which had been treated with 0.49 part of ammonium sulphamate for 4 hours at 200°C, were added to the above solution and the slurry stirred until homogeneous (approximately 1 hour).

The slurry was cast on glass plates to form a film 0.006 in. thick which was cut, shredded and made into cigarettes. When smoked, the cigarettes had a tobacco-like flavour and after-taste.

EXAMPLE 3

2.8 parts glycerol, 0.8 part citric acid and 1.0 part potassium citrate were dissolved in 20 parts distilled water and the resultant solution added to a stirred solution of 2 parts of sodium carboxymethyl cellulose in 80 parts hot distilled water. 1.27 parts of casein (fat-free), 10.13 parts of cellulose, which had been treated with 0.51 part of ammonium sulphamate for 4 hours at 200°C, and 2 parts of calcium carbonate were added to the above solution and the slurry stirred until homogeneous (approximately 1 hour).

The slurry was cast on glass plates to form a film 0.006 in. thick. The film was cut and shredded and mixed in the proportion 3:1 by weight with a commercial flue-cured cigarette tobacco shred and made up into cigarettes which, when smoked, had a tobacco-like flavor and after-taste superior to that of similar cigarettes not containing casein.

EXAMPLE 4

A film was made as described in Example 3 except that 1.22 parts of casein and 9.78 parts of cellulose, which had been treated with 0.49 part of ammonium sulphamate for 4 hours at 200°C, were used instead of 1.27 parts of casein and 10.13 parts of treated cellulose. In addition, 0.4 part of nicotine was added to the slurry.

The film was cut and shredded and made up into cigarettes which, when smoked, had a tobacco-like flavour and after-taste.

EXAMPLE 5

2.8 parts glycerol, 0.8 part citric acid and 1.0 part potassium citrate were dissolved in 20 parts distilled water and the resultant solution added to a stirred solution of 2 parts of sodium carboxymethyl cellulose in 80 parts hot distilled water. 1.27 parts of casein (fat-free), 2 parts of calcium carbonate, 5.9 parts of an anhydrous ethanol extract of tobacco dissolved in 50 parts of ethanol and 10.13 parts of cellulose, which had been treated with 0.51 part of ammonium sulphamate for 4 hours at 200°C, were added to the above solution and the mixture stirred until homogeneous. This slurry was cast into sheet, shredded and made up into cigarettes which, when smoked, had a tobacco-like flavour.

EXAMPLE 6

Cigarettes made up according to the procedure of Example 1 were compared with cigarettes made up to the same formulation except that the groundnut protein was omitted and that 11.4 parts of heat-treated cellulose were used instead of 10.13 parts. It was found that cigarettes of equivalent firmness to the touch and of equivalent draw resistance when smoking contained 0.9 g. or less of the protein-containing material, compared with 1.0 g. or more for the cigarettes made with protein-free material.

EXAMPLE 7

1.34 parts of glycerol and 0.78 part of potassium citrate dissolved in 4 parts distilled water were mixed with 1.92 parts of sodium carboxymethyl cellulose dissolved in 96 parts hot distilled water. 6.73 parts of magnesium carbonate (magnesite), 3.86 parts of calcium carbonate, 0.1 part of the protein casein (extracted for 48 hours with petroleum ether at 30°C) and 5.28 parts of a material made by heating $\alpha$-cellulose with ammonium sulphamate for up to 4 hours at 200°C, were added to the above mixture and the whole stirred until homogeneous (about 1 hour).

The slurry was cast on glass plates to give a film 0.006 in. thick which was dried, removed from the plates, cut and shredded. When the shred was made into cigarettes and smoked it had a tobacco-like flavour and after-taste.

EXAMPLE 8

1.34 parts of glycerol and 0.78 part of potassium citrate dissolved in 4 parts distilled water were mixed with 1.92 parts of sodium carboxymethyl cellulose dissolved in 96 parts hot distilled water. 6.73 parts of magenesium carbonate (magnesite), 3.86 parts of calcium carbonate, 1.0 part of the protein casein (extracted for 48 hours with petroleum ether at 30°C) and 4.38 parts of a material made by heating $\alpha$-cellulose with ammonium sulphamate for up to 4 hours at 200°C, were added to the above mixture and the whole stirred until homogeneous (about 1 hour).

The slurry was cast on glass plates to give a film 0.006 in. thick which was dried, removed from the plates, cut and shredded. When the shred was made into cigarettes and smoked, it had a tobacco-like flavour and after-taste.

EXAMPLE 9

1.34 parts of glycerol and 0.78 part of potassium citrate dissolved in 4 parts distilled water were mixed with 1.92 parts of sodium carboxymethyl cellulose dissolved in 96 parts hot distilled water. 6.73 parts of magnesium carbonate (magnesite), 3.86 parts of calcium carbonate, 0.2 part of the protein casein (extracted for 48 hours with petroleum ether at 30°C) and 5.18 parts of a material made by heating α-cellulose with ammonium sulphamate for up to 4 hours at 200°C were added to the mixture and the whole stirred until homogeneous (about 1 hour).

The slurry was cast on glass plates to give a film 0.006 in. thick which was dried, removed from the plates, cut and shredded. When the shred was made into cigarettes and smoked, it had a tobacco-like flavour and after-taste.

EXAMPLE 10

2.8 parts glycerol, 0.8 part citric acid and 1.0 part potassium citrate were dissolved in 20 parts distilled water and the resultant solution added to a stirred solution of 2 parts sodium carboxymethyl cellulose in 80 parts hot distilled water. 1.7 parts of groundnut protein (lypro), which had been extracted for 48 hours at 30°C with petroleum ether (40/60). 10.16 parts α-cellulose powder and 2 parts calcium carbonate were added to the above solution and the slurry stirred until homogeneous (approximately 1 hour).

The slurry was cast on glass plates to form a film 0.006 in. thick which was shredded and made into cigarettes. When smoked, the cigarettes had a tobacco-like flavour and after-taste.

EXAMPLE 11

2.8 parts glycerol, 0.8 part citric acid and 1.0 part potassium citrate were dissolved in 20 parts distilled water and the resultant solution added to a stirred solution of 2 parts sodium carboxymethyl cellulose in 80 parts hot distilled water. 2.28 parts of gelatine together with 9.12 parts of α-cellulose powder and 2 parts calcium carbonate were added to the above solution and the slurry stirred until homogeneous (approximately 1 hour).

The slurry was cast on glass plates to form a film 0.006 in. thick which was cut, shredded and made into cigarettes. The cigarettes smoked to give a tobacco-like flavour and after-taste but accompanied by a somewhat sickly unpleasant aroma.

EXAMPLE 12

2.8 parts glycerol, 0.8 part citric acid and 1.0 part potassium citrate were dissolved in 20 parts distilled water and the resultant solution added to a stirred solution of 2 parts sodium carboxymethyl cellulose in 80 parts hot distilled water. 2.28 parts gelatine, which had been extracted for 48 hours at 30°C with petroleum ether (40/60), 9.12 parts α-cellulose and 2 parts calcium carbonate were added to the above solution and the slurry stirred until homogeneous (approximately 1 hour).

The slurry was cast on glass plates to form a film 0.006 in. thick which was cut, shredded and made into cigarettes. The cigarettes smoked to give a tobacco-like flavour and after-taste.

EXAMPLE 13

2.8 parts glycerol, 0.8 part citric acid and 1.0 part potassium citrate were dissolved in 20 parts distilled water and the resultant solution added to a stirred solution of 2 parts sodium carboxymethyl cellulose in 80 parts hot distilled water. 2.28 parts of groundnut protein (lypro), which had been extracted for 48 hours at 30°C with petroleum ether(40/60), 9.12 parts of rice starch and 2 parts of calcium carbonate were added to the above solution and the slurry stirred until homogeneous (approximately 1 hour).

The slurry was cast on glass plates to form a film 0.006 in. thick which was then cut, shredded and made into cigarettes. When smoked, the cigarettes gave a tobacco-like flavour and after-taste.

EXAMPLE 14

2.8 parts glycerol, 0.8 part citric acid and 1.0 part potassium citrate were dissolved in 20 parts distilled water and the resultant solution added to a stirred solution of 2 parts of sodium carboxymethyl cellulose in 80 parts hot distilled water. 2.28 parts of casein (fat-free). 9.12 parts of α-cellulose powder and 2 parts of calcium carbonate were added to the above solution and the slurry stirred until homogeneous (approximately 1 hour).

The slurry was cast on glass plates to form a film 0.006 in. thick. This film was cut and shredded and mixed in the proportion 3:1 by weight with a commercial flue-cured cigarette tobacco shred and made up into cigarettes which, when smoked, had a tobacco-like flavour after-taste and this was superior to similar cigarettes not containing casein.

EXAMPLE 15

1.34 parts of glycerol and 0.78 part of potassium citrate dissolved in 4 parts distilled water were mixed with 1.92 parts of sodium carboxymethyl cellulose dissolved in 96 parts hot distilled water. 6.72 parts of magnesium carbonate (magnesite), 3.86 parts of calcium carbonate, 0.42 part of an enzyme hydrolysate of the protein casein and 4.96 parts of a material made by heating α-cellulose with ammonium sulphamate for up to 4 hours at 200°C, were added to the above mixture and the whole stirred until homogeneous (about 1 hour).

The slurry was cast on glass plates to give a film 0.006 in. thick which was dried, removed from the plates, cut and shredded. When the shred was made into cigarettes and smoked, it had a tobacco-like flavour and after-taste.

EXAMPLE 16

1.34 parts of glycerol and 0.78 part of potassium citrate dissolved in 4 parts distilled water were mixed with 1.92 parts of sodium carboxymethyl cellulose dissolved in 96 parts hot distilled water. 6.72 parts of magnesium carbonate (magnesite), 3.86 parts of calcium carbonate, 0.38 part of the protein casein (extracted for 48 hours with petroleum ether at 30°C) and 5.0 parts of rice starch were added to the above mixture and the whole stirred until homogeneous (about 1 hour).

The slurry was cast on glass plates to give a film 0.006 in. thick which was dried, removed from the plates, cut and shredded. When the shred was made into cigarettes and smoked, it had a tobacco-like flavour and after-taste.

EXAMPLE 17

1.34 parts of glycerol and 0.78 part of potassium citrate dissolved in 4 parts distilled water were mixed with 1.92 parts of sodium carboxymethyl cellulose dissolved in 96 parts hot distilled water. 6.72 parts of magnesium carbonate (magnesite), 3.86 parts of calcium carbonate, 0.38 part of the protein casein (extracted for 48 hours with petroleum ether at 30°C) and 5.0 parts of α-cellulose were added to the above mixture and the whole stirred until homogeneous (about 1 hour).

The slurry was cast on glass plates to give a film 0.006 in. thick which was dried, removed from the plates, cut and shredded. When the shred was made into cigarettes and smoked, it had a tobacco-like flavour and after-taste.

EXAMPLE 18

1.8 parts of glycerol dissolved in 4 parts of distilled water were mixed with 2.4 parts sodium carboxymethyl cellulose dissolved in 96 parts distilled water. 5.98 parts of magnesium carbonate (magnesite), 3.44 parts of calcium carbonate, 0.09 parts of protein casein, 1 part bentonite and 5.29 parts of a material made by heating α-cellulose with ammonium sulphamate were added to the above mixture and the whole stirred until homogeneous (about 1 hour).

The slurry was cast on glass plates and dried to give a film 0.006 in. thick. The film was removed, shredded and made into cigarettes.

The cigarettes on smoking had a tobacco-like flavour and after-taste.

EXAMPLE 19

1.8 parts of glycerol dissolved in 4 parts of distilled water were mixed with 2.4 parts sodium carboxymethyl cellulose dissolved in 96 parts distilled water. 5.98 parts of magnesium carbonate (magnesite), 3.44 parts of calcium carbonate, 2.79 parts of protein casein, 1 part bentonite and 2.79 parts of a material made by heating α-cellulose with ammonium sulphamate were added to the above mixture and the whole stirred until homogeneous (about 1 hour).

The slurry was cast on glass plates and dried to give a film 0.006 in. thick. The film was removed, shredded and made into cigarettes.

The cigarettes on smoking had a cigar/tobacco-like flavour and after-taste.

EXAMPLE 20

1.8 parts of glycerol dissolved in 4 parts of distilled water were mixed with 2.4 parts sodium carboxymethyl cellulose dissolved in 96 parts distilled water. 5.98 parts of magnesium carbonate (magnesite), 3.44 parts of calcium carbonate, 0.4 parts of protein casein, 1 part bentonite and 4.98 parts of a condensate of succinaldehyde (see U.K. Patent Application No. 22270/69) were added to the above mixture and the whole stirred until homogeneous (about 1 hour).

The slurry was cast on glass plates and dried to give a film 0.006 in. thick. The film was removed, shredded and made into cigarettes.

The cigarettes on smoking had a tobacco-like flavour and aftertaste.

EXAMPLE 21

1.8 parts of glycerol dissolved in 4 parts of distilled water were mixed with 2.4 parts sodium carboxymethyl cellulose dissolved in 96 parts distilled water. 5.98 parts of magnesium carbonate (magnesite), 3.44 parts of calcium carbonate, 0.4 parts of protein casein, 1 part bentonite and 4.98 parts of oxidised cellulose were added to the above mixture and the whole stirred until homogeneous (about 1 hour).

The slurry was cast on glass plates and dried to give a film 0.006 in. thick. The film was removed, shredded and made into cigarettes.

The cigarettes on smoking had a tobacco-flavour and after-taste.

EXAMPLE 22

1.8 parts of glycerol dissolved in 4 parts of distilled water were mixed with 2.4 parts sodium carboxymethyl cellulose dissolved in 96 parts distilled water. 5.98 parts of magnesium carbonate (magnesite), 3.44 parts of calcium carbonate, 0.4 parts of zein protein, 1 part bentonite and 4.98 parts of a material made by heating α-cellulose with ammonium sulphamate were added to the above mixture and the whole stirred until homogeneous (about 1 hour).

The slurry was cast on glass plates and dried to give a film 0.006 in. thick. The film was removed, shredded and made into cigarettes.

The cigarettes on smoking had a tobacco-like flavour and after-taste.

EXAMPLE 23

1.8 parts of glycerol dissolved in 4 parts of distilled water were mixed with 2.4 parts sodium carboxymethyl cellulose dissolved in 96 parts distilled water. 5.98 parts of magnesium carbonate (magnesite), 3.44 parts of calcium carbonate, 0.4 parts of protein peptone, 1 part bentonite and 4.98 parts of a material made by heating α-cellulose with ammonium sulphamate were added to the above mixture and the whole stirred until homogeneous (about 1 hour).

The slurry was cast on glass plates and dried to give a film 0.006 in. thick. The film was removed, shredded and made into cigarettes.

The cigarettes on smoking had a tobacco-like flavour and after-taste.

EXAMPLE 24

1.8 parts of glycerol dissolved in 4 parts of distilled water were mixed with 2.4 parts sodium carboxymethyl cellulose dissolved in 16 parts distilled water. 5.98 parts of magnesium carbonate (magnesite), 3.44 parts of calcium carbonate, 0.4 parts of gliadin protein, 1 part bentonite and 4.98 parts of a material made by heating α-cellulose with ammonium sulphamate were added to the above mixture and the whole stirred until homogeneous (about 1 hour).

The slurry was cast on glass plates and dried to give a film 0.006 in. thick. The film was removed, shredded and made into cigarettes.

The cigarettes on smoking had a tobacco-like flavour and after-taste.

EXAMPLE 25

0.34 parts glycerol were dissolved in 4 parts distilled water and mixed with 6.6 parts sodium carboxymethyl cellulose dissolved in 96 parts water. 6.2 parts dolomite(Dolodust), 5.6 parts of diatomaceous earth (Celite), 0.22 parts charcoal, 0.34 parts octanol and 0.4 parts casein protein were added to the above mixture and the whole stirred until homogeneous (about 1 hour).

The slurry was cast onto glass plates and dried to give a film 0.006 in. thick. The film was removed, shredded and made into cigarettes.

When the treated shred was made into cigarettes and smoked in comparison with a similar cigarette not containing the protein additive there was a marked preference for the cigarette with the additive because of improved taste and after-taste which had a cigar/pipe tobacco nature.

EXAMPLE 26

19.8 parts of enzymatically hydrolyzed lettuce leaf shred was sprayed with a solution of 0.2 parts casein protein in 10 parts aqueous ammonia and the solvent allowed to evaporate.

When the treated shred was made into cigarettes and smoked it showed improved features of taste and after-taste compared with the compositions containing no additives.

What we claim is:

1. A smoking mixture comprising a thermally degraded carbohydrate tobacco substitute as the essential smoke-producing fuel, alkali or alkaline earth carbonates, sodium carboxymethyl cellulose, and a protein selected from the group consisting of casein, groundnut protein, soyabean protein, zein, albumin or gliadin, the amount of protein to the said smoke producing fuel being in the range 1:8 to 1:60, the amount of alkali or alkaline earth carbonates to the said smoke-producing fuel, and the amount of sodium carboxymethyl cellulose to the said smoke producing fuel each being at least about 1:5 by weight and said thermally degraded carbohydrate being obtained by subjecting a carbohydrate material to a catalysed degradation process at a temperature of at least 100° C until the weight of the degraded material is approximately 90% or less of the dry weight of the original carbohydrate.

2. A smoking mixture as claimed in claim 1 wherein the amount of protein to smoke producing fuel is 1:8 to 1.30.

3. A smoking mixture as claimed in claim 2 comprising thermally degraded cellulose.

4. A smoking mixture as claimed in claim 1 wherein the protein is casein.

5. A smoking mixture as claimed in claim 1 wherein the protein is pure and free of residual fat.

6. A smoking material as claimed in claim 1 wherein the alkaline earth carbonate is selected from the group consisting of calcium carbonate, magnesium carbonate or mixtures thereof.

* * * * *